US007058572B1

(12) United States Patent
Nemer

(10) Patent No.: US 7,058,572 B1
(45) Date of Patent: Jun. 6, 2006

(54) REDUCING ACOUSTIC NOISE IN WIRELESS AND LANDLINE BASED TELEPHONY

(75) Inventor: Elias J. Nemer, Montreal (CA)

(73) Assignee: Nortel Networks Limited, St. Laurent (CA)

( * ) Notice: Subject to any disclaimer, the term of this patent is extended or adjusted under 35 U.S.C. 154(b) by 0 days.

(21) Appl. No.: 09/493,709

(22) Filed: Jan. 28, 2000

(51) Int. Cl.
*G10L 21/02* (2006.01)

(52) U.S. Cl. ..... 704/226

(58) Field of Classification Search ..... 704/200, 704/200.1, 219–245; 375/371; 381/94.3, 381/317; 379/93.31

See application file for complete search history.

(56) References Cited

U.S. PATENT DOCUMENTS 4,630,304 A * 12/1986 Borth et al. ..... 381/94.3
4,811,404 A 3/1989 Vilmur et al.
5,166,981 A * 11/1992 Iwahashi et al. ..... 704/230
5,235,669 A * 8/1993 Ordentlich et al. ..... 704/200
5,406,635 A 4/1995 Jarvinen
5,432,859 A 7/1995 Yang et al.
5,485,522 A 1/1996 Solve et al.
5,485,524 A 1/1996 Kuusama et al.

(Continued)

FOREIGN PATENT DOCUMENTS

EP 0588526 A1 3/1994

OTHER PUBLICATIONS

O. Cappe, "Elimination of the musical noise phenomena with the Ephraim and Malah noise suppressor", IEEE trans. On speech and audio processing , vol. 2, No. 2, Apr. 1994, pp. 345-349.

(Continued)

*Primary Examiner*—David D. Knepper
(74) *Attorney, Agent, or Firm*—Mintz Levin CohnFerris Glovsky and Popeo, PC

(57) ABSTRACT

Acoustic noise for wireless or landline telephony is reduced through optimal filtering in which each frequency band of every time frame is filtered as a function of the estimated signal-to-noise ratio and the estimated total noise energy for the frame. Non-speech bands and other special frames are further attenuated by one or more predetermined multiplier values. Noise in a transmitted signal formed of frames each formed of frequency bands is reduced. A respective total signal energy and a respective current estimate of the noise energy for at least one of the frequency bands is determined. A respective local signal-to-noise ratio for at least one of the frequency bands is determined as a function of the respective signal energy and the respective current estimate of the noise energy. A respective smoothed signal-to-noise ratio is determined from the respective local signal-to-noise ratio and another respective signal-to-noise ratio estimated for a previous frame. A respective filter gain value is calculated for the frequency band from the respective smoothed signal-to-noise ratio. Also, it is determined whether at least a respective one as a plurality of frames is a non-speech frame. When the frame is a non-speech frame, a noise energy level of at least one of the frequency bands of the frame is estimated. The band is filtered as a function of the estimated noise energy level.

96 Claims, 6 Drawing Sheets

U.S. PATENT DOCUMENTS

| | | | | | |
|---|---|---|---|---|---|
| 5,668,927 | A | * | 9/1997 | Chan et al. | 704/240 |
| 5,706,394 | A | * | 1/1998 | Wynn | 704/219 |
| 5,708,754 | A | * | 1/1998 | Wynn | 704/219 |
| 5,710,863 | A | * | 1/1998 | Chen | 704/200.1 |
| 5,790,759 | A | * | 8/1998 | Chen | 704/200.1 |

OTHER PUBLICATIONS

Y. Ephraim and D. Malah. "Speech enhancement using a minimum mean-square error short-time spectral amplitude estimator" IEEE trans. ASSP, vol. ASSP-32, pp. 1109-1121, Dec. 1984.

B. Moore and B. Glasberg. "Suggested formulae for calculating auditory-filter bandwidths and excitation patterns", Journal Acoustical Society of America., vol. 74, No. 3, Sep. 1983, pp. 750-753.

J. Sohn, N. Kim, W. Sung. "A statistical model-based voice activity detection", IEEE Signal Processing Letters, vol. 6, No. 1, Jan. 1999, pp. 1-3.

Yang, "Frequency domain noise suppression approaches in mobile telephone systems", Proc. ICASSP 1993, pp. 363-366.

* cited by examiner dB scale

Linear scale

| | Case | Conditions to be met | value of update constant α |
|---|---|---|---|
| 602 | Watch dog timer expired | $UpdateTimer > TimeOut$<br>$PredErr > T_{PE1}$ | $\alpha = 0.002$ |
| 604 | Frame is stationary | Stationary counter is > 0.5 sec. | $\alpha = 0.05$ |
| 606 | Frame speech likelihood indicates non-speech | $SpeechLikelihood < T_{LIK}$<br>$PredErr > T_{PE2}$ | $\alpha = 0.1\ SpeechLikelihood$<br>with $\alpha \leq 0.1$ |
| 608 | The LPC residual of the frame has near-zero skewness | $\lvert\gamma_3\rvert < T_a,\ \lvert\gamma_3'\rvert < T_b,$<br>$PredErr > T_{PE2}$ | $\alpha = 0.05$ |
| 610 | Noise energy is dropping | Current noise energy estimate > total energy | $\alpha = 0.1$ |

FIG. 6

REDUCING ACOUSTIC NOISE IN WIRELESS AND LANDLINE BASED TELEPHONY

BACKGROUND OF THE INVENTION

The present invention is directed to wireless and landline based telephone communications and, more particularly, to reducing acoustic noise, such as background noise and system induced noise, present in wireless and landline based communication.

The perceived quality and intelligibility of speech transmitted over a wireless or landline based telephone lines is often degraded by the presence of background noise, coding noise, transmission and switching noise, etc. or by the presence of other interfering speakers and sounds. As an example, the quality of speech transmitted during a cellular telephone call may be affected by noises such as car engines, wind and traffic as well as by the condition of the transmission channel used.

Wireless telephone communication is also prone to providing lower perceived sound quality than wire based telephone communication because the speech coding process used during wireless communication results in some signal loss. Further, when the signal itself is noisy, the noise is encoded with the signal and further degrades the perceived sound quality because the speech coders used by these systems depend on encoding models intended for clean signals rather than for noisy signals. Wireless service providers, however, such as personal communication service (PCS) providers, attempt to deliver the same service and sound quality as landline telephony providers to attain greater consumer acceptance, and therefore the PCS providers require improved end-to-end voice quality.

Additionally, transmitted noise degrades the capability of speech recognition systems used by various telephone services. The speech recognition systems are typically trained to recognize words or sounds under high transmission quality conditions and may fail to recognize words when noise is present.

In older wireline networks, such as are found in developing countries, system induced noise is often present because of poor wire shielding or the presence of cross talk which degrades sound quality. System induced noise is also present in more modern telephone communication systems because of the presence of channel static or quantization noise.

It is therefore desirable to provide wireless and landline telephone communication in which both the background noise and the system induced noise are reduced.

When noise reduction is carried out prior to encoding the transmitted signal, a significant portion of the additive noise is removed which results in better end-to-end perceived voice quality and robust speech coding. However, noise reduction is not always possible prior to encoding and therefore must be carried out after the signals have been received and/or decoded, such as at a base station or a switching center.

Existing commercial systems typically reduce encoded noise using spectral decomposition and spectral scaling. Known methods include estimating the noise level, computing the filter coefficients, smoothing the signal to noise ratio (SNR), and/or splitting the signal into respective bands. These methods, however, have the shortcomings that artifacts, known as musical noise, as well as speech distortions are produced.

Typically, the known noise reduction methods are based on generating an optimized filter that includes such methods as Wiener filtering, spectral subtraction and maximum likelihood estimation. However, these methods are based on assumed idealized conditions that are rarely present during actual transmission. Additionally, these methods are not optimized for transmitting human speech or for human perception of speech, and therefore the methods must be altered for transmitting speech signals. Further, the conventional methods assume that the speech and noise spectra or the sub-band signal to noise ratio (SNR) are known beforehand, whereas the actual speech and noise spectra change over time and with transmission conditions. As a result, the band SNR is often incorrectly estimated and results in presence of musical noise. Additionally, when Wiener filtering is used, the filtering is based on minimum means square error (MMSE) optimized conditions that are not always appropriate for transmitting speech signals or for human perception of the speech signals.

FIG. 1 illustrates a known method of spectral subtraction and scaling to filter noisy speech. A noisy speech signal is first buffered and windowed, as shown at step 102, and then undergoes a fast Fourier transform (FFT) into L frequency bins or bands, as shown at step 104. The energy of each of the bands is computed, as step 106 shows, and the noise level of each of the bands is estimated, as shown at step 110. The SNR is then estimated based on the computed energy and the estimated noise, as shown at step 108, and then a value of the filter gain is determined based on the estimated SNR, as shown at step 112. The calculated value of the gain is used as a multiplier value, as shown in step 114, and then the adjusted L frequency bins or bands undergo an inverse FFT or are passed through a synthesis filter bank, as step 116 shows, to generate an enhanced speech signal $y_{bt}$.

Various methods of carrying out the respective steps shown in FIG. 1 are known in the art:

As an example, U.S. Pat. No. 4,811,404, titled "Noise Suppression System" to R. Vimur et al. which issued on Mar. 7, 1989, describes spectral scaling with sub-banding. The spectral scaling is applied in a frequency domain using a FFT and an IFFT comprised of 128 speech samples or data points. The FFT bins are mapped into 16 non-homogeneous bands roughly following a known Bark scale.

When the filtered gains are computed for each sub-band, the amount of attenuation for each band is based on a non-linear function of the estimated SNR for that band. Bands having a SNR value less than 0 dB are assigned the lowest attenuation value of 0.17. Transient noise is detected based on the number of bands that are below or above the threshold value of 0 dB.

Noise energy values are estimated and updated during silent intervals, also known as stationary frames. The silent intervals are determined by first quantizing the SNR values according to a roughly exponential mapping and by then comparing the sum of the SNR values in 16 of the bands, known as a voice metric, to a threshold value. Alternatively, the noise energy value is updated using first-recursive averaging of the channel energy wherein an integration constant is based on whether the energy of a frame is higher than or similar to the most recently estimated energy value.

Artifacts are removed by detecting very weak frames and then scaling these frames according the minimum gain value, 0.17. Sudden noise bursts in respective frames are detected by counting the number of bands in the frame whose SNR exceeds a predetermined threshold value. It is assumed that speech frames have a large number of bands that have a high SNR and that sudden noise burst is characterized by frames in which only a small number of bands have a high SNR.

Another example, European Patent No. EP 0,588,526 A1, titled "A Method Of And A System For Noise Suppression" to Nokia Mobile Phones Ltd. which issued on Mar. 23, 1994, describes using FFT for spectral analysis. Format locations are estimated whereby speech within the format locations is attenuated less than at other locations.

Noise is estimated only during speech intervals. Each of the filter passbands is split into two sub-bands using a special filter. The filter passbands are arranged such that one of the two sub-bands includes a speech harmonic and the other includes noise or other information and is located between two consecutive harmonic peaks.

Additionally, random flutter effect is avoided by not updating the filter coefficient during speech intervals. As a result, the filter gains convert poorly during changing noise and speech conditions.

A further example, U.S. Pat. No. 5,485,522, titled "System For Adaptively Reducing Noise In Speech Signals" to T. Solve et al. which issued on Jan. 16, 1996, is directed to attenuation applied in the time domain on the entire frame without sub-banding. The attenuation function is a logarithmic function of the noise level, rather than of the SNR, relative to a predefined threshold. When the noise level is less than the threshold, no attenuation is necessary. The attenuation function, however, is different when speech is detected in a frame rather than when the frame is purely noise.

A still further example, U.S. Pat. No. 5,432,859, titled "Noise Reduction System" to J. Yang et al. which issued on Jul. 11, 1995, describes using a sliding dual Fourier transform (DFT). Analysis is carried out on samples, rather than on frames, to avoid random fluctuation of flutter noise. An iterative expression is used to determine the DFT, and no inverse DFT is required. The filter gains of the higher frequency bins, namely those greater than 1 KHz, are set equal to the highest determined gain. The filter gains for the lower frequency bins are calculated based on a known MMSE-based function of the SNR. When the SNR is less than −6 dB, the gains are set to a predetermined small value.

It is desirable to provide noise reduction that avoids the weaknesses of the known spectral subtraction and spectral scaling methods.

SUMMARY OF THE INVENTION

The present invention provides acoustic noise reduction for wireless or landline telephony using frequency domain optimal filtering in which each frequency band of every time frame is filtered as a function of the estimated signal-to-noise ratio (SNR) and the estimated total noise energy for the frame and wherein non-speech bands, non-speech frames and other special frames are further attenuated by one or more predetermined multiplier values.

In accordance with the invention, noise in a transmitted signal comprised of frames each comprised of frequency bands is reduced. A respective total signal energy and a respective current estimate of the noise energy for at least one of the frequency bands is determined. A respective local signal-to-noise ratio for at least one of the frequency bands is determined as a function of the respective signal energy and the respective current estimate of the noise energy. A respective smoothed signal-to-noise ratio is determined from the respective local signal-to-noise ratio and another respective signal-to-noise ratio estimated for a previous frame. A respective filter gain value is calculated for the frequency band from the respective smoothed signal-to-noise ratio.

According to another aspect of the invention, noise is reduced in a transmitted signal. It is determined whether at least a respective one as a plurality of frames is a non-speech frame. When the frame is a non-speech frame, a noise energy level of at least one of the frequency bands of the frame is estimated. The band is filtered as a function of the estimated noise energy level.

Other features and advantages of the present invention will become apparent from the following detailed description of the invention with reference to the accompanying drawings.

BRIEF DESCRIPTION OF THE DRAWINGS

The invention will now be described in greater detail in the following detailed description with reference to the drawings in which:

FIG. 6 shows the conditions under which the estimated noise energy is updated according to the invention.

DETAILED DESCRIPTION OF THE INVENTION

Figure 1:
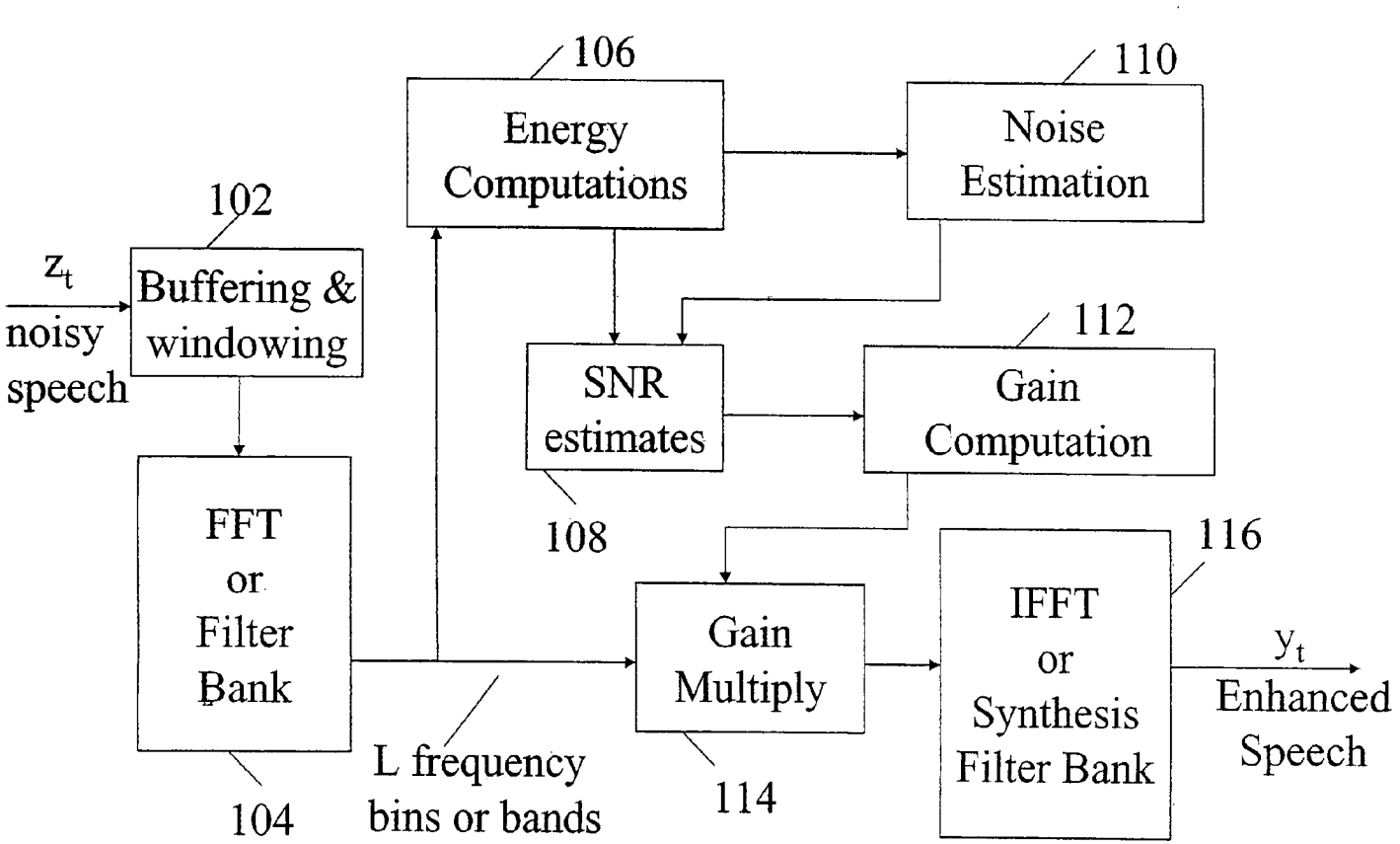
FIG. 1 PRIOR ART
FIG. 1 is a block diagram showing a known spectral subtraction scaling method.

The invention is an improvement of the known spectral subtraction and scaling method shown in FIG. 1 and achieves better noise reduction with reduced artifacts by better estimating the noise level and by improved detection of non-speech frames. Additionally, the invention includes a non-linear suppression scheme. Included are: (1) a new non-linear gain function that depends on the value of the smoothed SNR and which corrects the shortcomings of the Wiener filter and other classical filters that have a fast rising slope in the lower SNR region; (2) an adjustable aggressiveness control parameter that varies the percentage of the estimated noise that is to be removed (A set of spectral gains are derived based on the aggressiveness parameter and based on the nominal gain. The spectral gains are used to scale the FFT speech samples or points, and the nominal gains determine the feedback loop operation.); (3) non-speech frames are determined using at least one of four metrics: (a) a speech likelihood measure (also known as a noise likelihood measure), (b) changes of the energy envelope, (c) a linear predictive coding (LPC) prediction error and (d) third order statistics of the LPC residual (Frames are determined to be non-speech frames when the signal is stationary for a predetermined interval. Stationary signals are detected as a function of changes in the energy envelope within a time window and based on the LPC prediction error. The LPC prediction error is used to avoid erroneously determining that frames representing sustained vowels or tones are non-speech frames. Alternatively, frames are determined to be non-speech frames based on the value of the normalized skewness of the LPC residual, namely the third order statistics of the LPC residual, and based on the LPC prediction error. As a further alternative, frames are determined to be non-speech frames based on the value of the frequency weighted speech likelihood measure determined across all frequency bands and combined with the LPC error.); (4) a "soft noise" estimation is used and determines the probability that a respective frame is noisy and is based on the log-likelihood measure; (5) a watchdog timer mechanism detects non-convergence of the updating of the estimated noise energy and forces an update when it times out (The forced update uses frames having a LPC prediction error outside the nominal range for speech signals. The timer mechanism ensures proper convergence of the updated noise energy estimate and ensures fast updates.); and (6) marginal non-speech frames that are likely to contain only residual and musical noise are identified and further attenuated based on the total number of bands within the frame that have a high or low likelihood of representing speech signals, as well as based on the prediction error and the normalized skewness of the bands.

The invention carries out noise reduction processing in the frequency domain using a FFT and a perceptual band scale. In one example of the invention, the FFT speech samples or points are assigned to frequency bands along a perceptual frequency scale. Alternatively, frequency masking of neighboring spectral components is carried out using a model of the auditory filters. Both methods attain noise reduction by filtering or scaling each frequency band based on a non-linear function of the SNR and other conditions.

Figure 2:
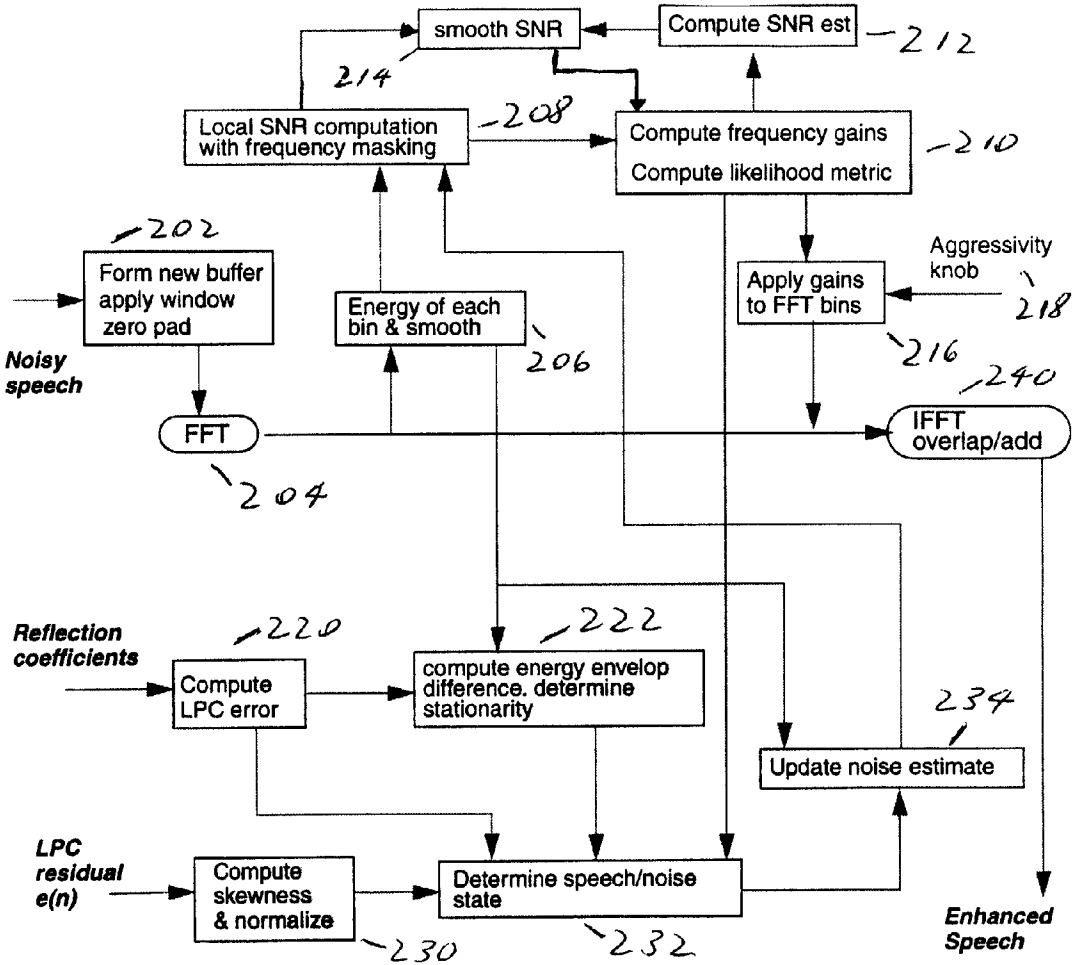
FIG. 2 is a block diagram showing a noise reduction method according to the invention.

FIG. 2 is a block diagram showing the steps of a noise reduction method in accordance with the invention. The method is carried out iteratively over time. At each iteration, N new speech samples or points of noisy speech are read and combined with M speech samples from the preceding frame so that there is typically a 25% overlap between the new speech samples and those of the proceeding frame, though the actual percentage may be higher or lower. The combined frame is windowed and zero padded, as shown at step 202, and then a L point FFT is performed, as shown at step 204. Then, as shown at step 208, the squares of the real and imaginary components of the FFT are summed for each frequency point to attain the value of the signal energy $E_x(f)$. A local SNR, known as the $SNR_{post}$, is then calculated at each frequency point as the ratio of the total energy to the current estimate of the noise energy, as shown at step 208. The locally computed SNR is averaged with the SNR estimated during the immediately preceding iteration of the filtering method, known as $SNR_{est}$, to obtain a smoothed SNR, as shown at step 214. The smoothed SNR is then used to compute the filter gains, as shown at step 210, which are applied to the FFT bins, as shown at step 216, and to compute the speech likelihood metric which are used to determine the speech and noise states, as step 232 shows. The filter gains are then used to calculate the value of the $SNR_{est}$ for the next iteration.

To determine the value of the local SNR, the total energy and the current estimate of the noise energy are first convolved with the auditory filter centered at the respective frequency to account for frequency masking, namely the effective neighboring frequencies. The convolution operation results in a perceptual total energy value that is derived from the total signal energy $E_x(f)$ as follows:

$$E_x^P(f)=W(f)\otimes E_x(f),$$

where ⊗denotes convolution and W(f) is the auditory filter centered at f. The convolution operation also results in a perceptual noise energy derived from the current estimate of the noise energy $E_n(f)$ as follows:

$$E_n^P(f)=W(f)\otimes E_n(f).$$

Using the discrete value for the frequency, these relations become:

$$E_x^P(f)=\sum_{m=0}^{K-1} W\left(\frac{|f-m|}{f+0.5}\right)E_x(f), \text{ and}$$

$$E_n^P(f)=\sum_{m=0}^{K-1} W\left(\frac{|f-m|}{f+0.5}\right)E_n(f).$$

The local SNR at the frequency f is then determined from the relation:

$$SNR_{post}(f)=POS\left[\frac{E_x^P(f)}{E_n^P(f)}-1\right],$$

where the function POS[x] has the value x when x is positive and has the value 0 otherwise. The value $SNR_{est}$ is then calculated from the relation:

$$SNR_{est}(f)=|G(f)|^2\cdot SNR_{post}(f),$$

where the filter gains G(s) are determined from the relation:

$$G(f)=C\cdot\sqrt{[SNRprior(f)]}.$$

The values $SNR_{post}$ from the current iteration and $SNR_{est}$ from the immediately preceding iteration are then averaged to attain $SNR_{prior}$ as follows:

$$SNR_{prior}(f)=(1-\gamma)SNR_{post}(f)+\gamma SNR_{est}(f),$$

where the symbol γ is a smoothing constant having a value between 0.5 and 1.0 such that higher values of γ result in a smoother SNR.

The invention also detects the presence of non-speech frames by testing for a stationary signal. The detection is based on changes in the energy envelope during a time interval and is based on the LPC prediction error. The log frame energy (FE), namely the logarithm of the sum of the signal energies for all frequency bands, is calculated for the current frame and for the previous K frames using the following relations:

$$FE|_{db}=10\cdot\log\left(\sum_f E_f\right).$$

Figure 3:
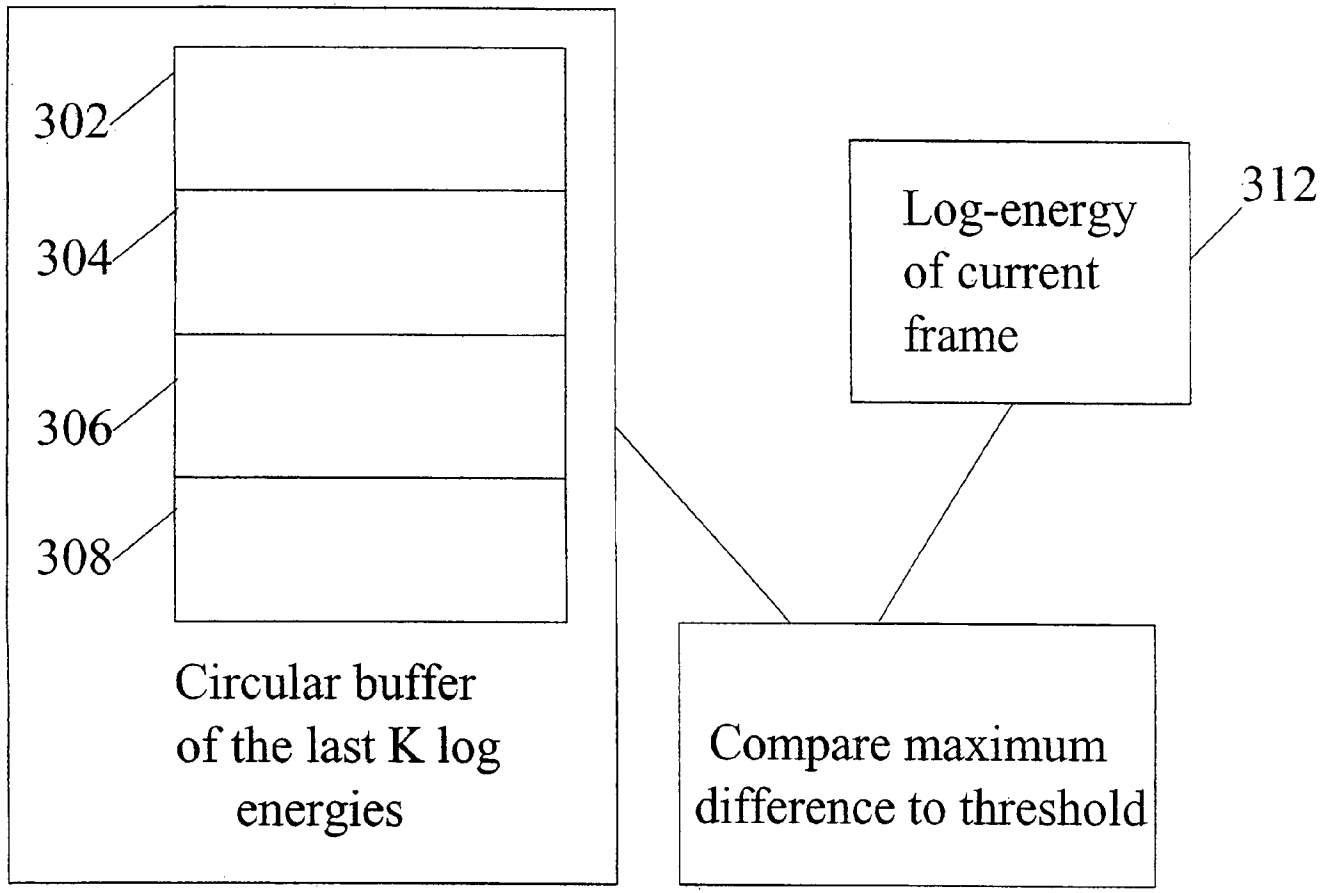
FIG. 3 shows the frames used to calculate the logarithm of the energy difference for detecting stationary frames.

The difference of the log frame energy is equivalent to determining the ratio of the energy between the current frame 312 and each of the last K frames 302, 304, 306 and 308. The largest difference between the log frame energy of the current frame and that of each of the last K frames is determined, as shown in FIG. 3. When the largest difference is less than a predefined threshold value, the energy contour has not changed over the interval of K frames, and thus the signal is stationary.

When the largest difference exceeds the threshold value for a preset time period, known as a hangover period, the stationary frames are likely to be non-speech frames because speech utterances typically have changing energy contours within time intervals of 0.5 to 1 seconds. However, the signal may be stationary signal during the utterance of a sustained vowel or during the presence of a in-band tone, such as a dial tone. To eliminate the likelihood of falsely detecting a non-speech frame, an LPC prediction error, which is the inverse of the LPC prediction gain, is determined from the reflection coefficient generated by the LPC analysis performed at the speech encoder. The LPC prediction error (PE) is determined from the following relation:

$$PE = \prod_{k=0}^{K-1} [1 - rc_k^2].$$

A low prediction error indicates the presence of speech frames, a near zero prediction error indicates the presence of sustained vowels or in-band tones, and a high prediction error indicates the presence of non-speech frames.

When the LPC prediction error is greater than a preset threshold value and the change of the log frame energies over the preceding K frames is less than another threshold value, a stationarity counter is activated and remains active up to the duration of the hangover period. When the stationarity counter reaches a preset value, the frame is determined to be stationary.

FIG. 2 also shows the detection of stationary frames by computing the LPC error, as shown at step 220, and the determination of stationarity, as step 222 shows. The log frame energies of the proceeding K frames is determined from the energy values determined at step 206.

The invention also determines the presence of non-speech frames using a statistical speech likelihood measurement from all the frequency bands of a respective frame. For each of the bands, the likelihood measure, Λ(f), is determined from the local SNR and the smoothed SNR described above using the following relation:

$$\Lambda(f) = \frac{e^{\left\{\left(\frac{SNR_{prior}(f)}{1+SNR_{prior}(f)}\right)SNR_{post}(f)\right\}}}{1 + SNR_{prior}(f)}.$$

The above relation is derived from a known statistical model for determining the FFT magnitude for speech and noise signals.

In accordance with the invention, the statistical speech likelihood measure of each frequency band is weighted by a frequency weighting function prior to combining the log frame likelihood measure across all the frequency bands. The weighting function accounts for the distribution of speech energy across the frequencies and for the sensitivity of human hearing as a function of the frequency. The weighted values are combined across all bands to produce a frame speech likelihood metric shown by the following relation:

$$SpeechLikelihood = \sum_f W(f) \cdot \log[\Lambda(f)].$$

To prevent the false detection of low amplitude speech segments, the speech likelihood is combined with the LPC prediction error described above before a decision is made to determine whether the frame is non-speech.

The invention also determines whether a frame is non-speech based on the normalized skewness of the LPC residual, namely based on the third order statistics of the sampled LPC residual e(n), $E[e(n)^3]$, which has a non-zero value for speech signals and has a value of zero in the presence of Gaussian noise. The skewness is typically normalized either by its variance, which is a function of the frame length, or by the estimate of the noise energy. The energy of the LPC residual, $E_x$, is determined from the following relation:

$$E_x = \frac{1}{N}\sum_{n=0}^{N-1} [e(n)]^2.$$

where e(n) are the sampled values of the LPC residual, and N is the frame length. The skewness SK of the LPC residual is determined as follows:

$$SK = \frac{1}{N}\sum_{n=0}^{N-1} [e(n)]^3.$$

The value of the normalized skewness as a function of the total energy is then determined from the following relation:

$$\gamma_3 = \frac{SK}{E_x^{1.5}}.$$

For a Gaussian process, the variance of the skewness has the following relation:

$$Var[SK] = \frac{15E_n^3}{N},$$

where $E_n$ is the estimate of the noise energy. The normalized skewness based on the variance of the skewness is determined from the following relation:

$$\gamma_3' = \frac{SK}{\sqrt{\frac{15E_n^3}{N}}}.$$

To detect the presence of non-speech frames, both the normalized skewness and the skewness combined with the LPC prediction error are utilized, as shown in Table 1.

Whenever a frame is determined to be a non-speech frame based on any of the above three methods, an updated noise energy value is estimated. Also, when the current estimate of the noise energy of a band in a frame is greater than the total energy of the band, the updated noise energy is similarly estimated. The estimated noise energy is updated by a smoothing operation in which the value of a smoothing constant depends on the condition required for estimating the noise energy. The new estimated noise energy value E(m+1,f) of each frequency band of a frame is determined from the prior estimated value E(m,f) and from the band energy $E_{ch}$(m,f) using the following relation:

$$E(m+1,f)=(1-\alpha)E(m,f)+\alpha E_{ch}(m,f)$$

where m is the iteration index and α is the update constant.

The estimation of the noise energy is essentially a feedback loop because the noise energy is estimated during non-speech intervals and is detected based on values such as the SNR and the normalized skewness which are, in turn, functions of previously estimated noise energy values. The feedback loop may fail to converge when, for example, the noise energy level goes to near zero for an interval and then again increases. This situation may occur, for example, during a cellular telephone handoff where the signal received from the mobile phone drops to zero at the base station for a short time period, typically about a second, and then again rises. Typically, the normalized skewness value, which is based on third order statistics, is not affected by such changes in the estimated noise level. However, the third order statistics do not always prevent failure to converge.

Therefore, the invention includes a watch dog timer to monitor the convergence of the noise estimation feed back loop by monitoring the time that has elapsed from the last noise energy update. If the estimated noise energy has not been updated within a preset time-out interval, typically three seconds, it is assumed that the feedback loop is not converging, and a forced noise energy update is carried out to return the feedback loop back to operation. Because a forced estimated noise energy update is used, a speech frame should not be used and, instead, the LPC prediction error is used to select the next frame or frames having a sufficiently high prediction error and therefore reduce the likelihood of choosing a speech frame. A forced update condition may continue as long as the feedback loop fails to converge. Typically, the duration of the forced update needed to bring the feedback loop back in convergence is fewer than five frames.

FIG. 6 shows the conditions under which the estimated noise energy is updated and the corresponding value of the update constant α. The first row 602 of FIG. 6 shows the conditions for which the estimated noise energy is forcibly updated and shows the value of the update constant α corresponding to a respective condition. When the watch dog timer has expired, the update constant has a value of 0.002. Row 604 shows that when a frame is determined to be stationary, the update constant has a value of 0.05. In row 606, when the speech likelihood is less than a threshold value $T_{LIK}$ and the LPC prediction error is greater than a threshold value $T_{PE2}$, the update constant has a value of 0.1. Row 608 shows that when the normalized skewness of the LPC residual has a near-zero value, namely when it has an absolute value less than a threshold $T_a$ (when normalized by total energy) or less than $T_b$ (when normalized by the variance), and when the LPC prediction error is greater than a threshold value $T_{PE2}$, the update constant has a value of 0.05. Row 610 shows that the current noise energy estimate is greater than the total energy, namely when the noise energy is decreasing, the update constant has a value of 0.1.

Figure 4A:
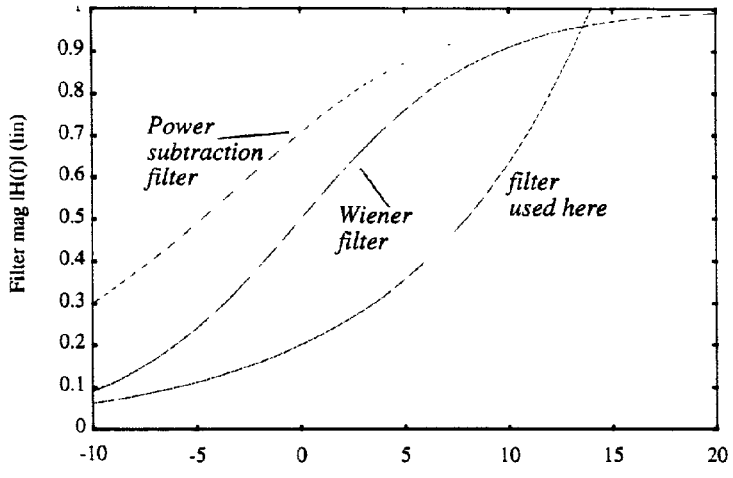
FIGS. 4A and 4B show the filter coefficient values as a function of SNR for the known power subtraction filter and the Wiener filter and according to the invention.
Figure 4B:
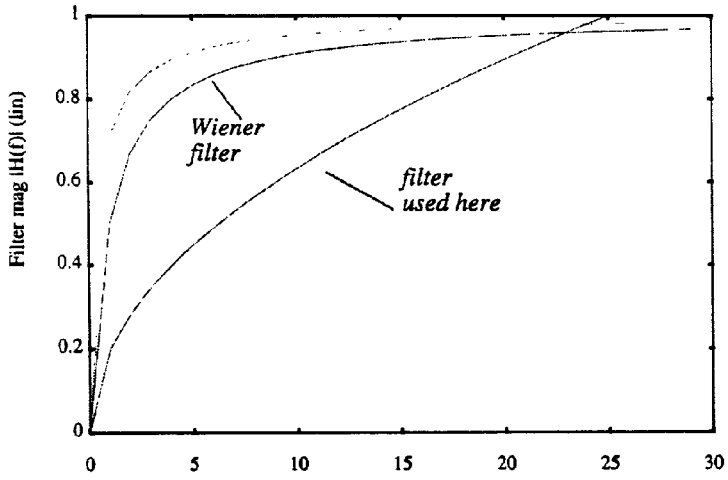

The invention also provides a filter gain function that reaches unity for SNR values above 13 dB, as FIGS. 4A and 4B show. At these values, the speech sounds mask the noise so that no attenuation is needed. Known classical filters, such as the Wiener filter or the power subtraction filter, have a filter gain function that rises quickly in the region where the SNR is just below 10 dB. The rapid rise in filter gain causes fluctuations in the output amplitude of the speech signals.

The gain function of the invention provides for a more slowly rising filter gain in this region so that the filter gain reaches a value of unity for SNR values above 13 dB. The smoothed SNR, $SNR_{prior}$, is used to determine the gain function, rather than the value of the local SNR, $SNR_{post}$, because the local SNR is found to behave more erratically during non-speech and weak-speech frames. The filter gain function is therefore determined by the following relation:

$$G(f)=C\cdot\sqrt{[SNR_{prior}(f)]},$$

where C is a constant that controls the steepness of the rise of the gain function and has a value between 0.15 and 0.25 and depends on the noise energy.

Further, when the speech likelihood metric described above is less than the speech threshold value, namely when the frequency band is likely to be comprised only of noise, the gain function G(f) is forced to have a minimum gain value. The gain values are then applied to the FFT frequency bands, as shown at step 216 of FIG. 2, prior to carrying out the IFFT, as shown at step 240.

The invention also provides for further control of the filter gains using a control parameter F, known as the aggressiveness "knob", that further controls the amount of noise removed and which has a value between 0 and 1. The aggressiveness knob parameter allows for additional control of the noise reduction and prevents distortion that results from the excessive removal of noise. Modified filter gains G'(f) are then determined from the above filter gains G(f) and from the aggressiveness knob parameter F according to the following relation:

$$G'(f)=\sqrt{[1-F\cdot(1-G(f)^2)]}.$$

The modified gain values are then applied to the corresponding FFT sample values in the manner described above.

The value of the aggressiveness knob parameter F may also vary with the frequency band of the frame. As an example, band having a frequencies less than 1 kHz may have high aggressiveness, namely high F values, because these bands have high speech energy, whereas bands having frequencies between 1 and 3 kHz may have a lower value of F.

Figure 5:
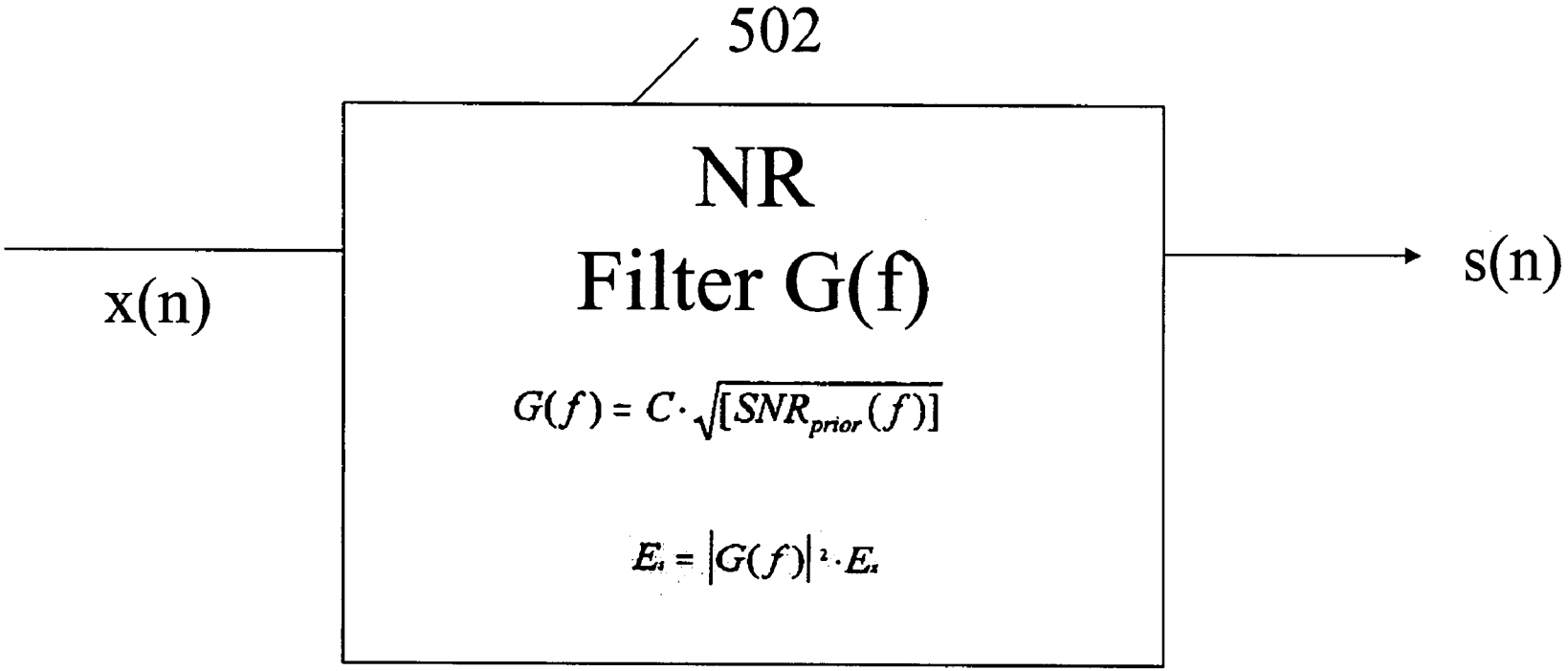
FIG. 5 shows the relation of the speech energy at the output of a noise reduction linear system according to the invention.

FIG. 5 shows the relation between the input and output energies of the speech bands as a function of the filter gain. The speech energy at the output of the suppression filter 502 is determined from the following relation:

$$E_s=|G(f)|^2\cdot E_x.$$

The noise energy removed is the difference between the output energy and the input energy and is shown as follows:

$$E_n=E_x-|G(f)|^2\cdot E_x$$

However, with certain frequencies, the removal of only a fraction of the noise, known as $E_n'$, using a new set of filter gains G'(f) is desirable. When the noise energy that is removed is adjusted based on the aggressiveness knob parameter F, the following relation is used:

$$E_n'=E_x-|G'(f)|^2\cdot E_x=F\{E_x-|G(f)|^2\cdot E_x\}$$

From this relation, the above equation determining the value of the adjusted gain G'(f) is derived.

The invention also detects and attenuates frames consisting solely of musical noise bands, namely frames in which a small percentage of the bands have a strong signal that, after processing, generates leftover noise having sounds similar to musical sounds. Because such frames are non-speech frames, the normalized skewness of the frame will not exceed its threshold value and the LPC prediction error will not be less than its threshold value so that the musical noise cannot ordinarily be detected. To detect these frames, the number of frequency bands having a likelihood metric above a threshold value are counted, the threshold value indicating that the bands are strong speech bands, and when the strong speech bands are less than 25% of the total number of frequency bands, the strong speech bands are likely to be musical noise bands and not actual speech bands. The detected speech bands are further attenuated by setting the filter gains G(f) of the frame to its minimum value.

Although the present invention has been described in relation to particular embodiment thereof, many other variations and modifications and other uses may become apparent to those skilled in the art. It is preferred, therefore, that the present invention be limited not by the specific disclosure herein, but only by the appended claims.

The invention claimed is:

1. A method of reducing noise in a transmitted signal comprised of a plurality of frames, each of said frames including a plurality of frequency bands; said method comprising the steps of:

determining a respective total signal energy and a respective current estimate of the noise energy for at least one of said plurality of frequency bands of at least one of said plurality of frames, wherein said respective current estimate of the noise energy is determined as a function of a linear predictive coding (LPC) prediction error;

determining a respective local signal-to-noise ratio (SNRpost) for said at least one of said plurality of frequency bands as a function of said respective signal energy and said respective current estimate of the noise energy;

determining a respective smoothed signal-to-noise ratio (SNRprior) for said at least one of said plurality of frequency bands from said respective local signal-to-noise ratio and another respective signal-to-noise ratio (SNRest) estimated for a previous frame; and calculating a respective filter gain value for said at least one of said plurality of frequency bands from said respective smoothed signal-to-noise ratio.

2. The method of claim 1 wherein said respective local signal-to-noise ratio ($SNR_{post}$) is determined by the following relation:

$$SNR_{post}(f) = POS\left[\frac{E_x^p(f)}{E_n^p(f)} - 1\right],$$

wherein POS[x] has the value x when x is positive and has the value 0 otherwise, $E_x^p(f)$ is a perceptual total energy value and $E_n^p(f)$ is a perceptual noise energy value.

3. The method of claim 2 wherein said perceptual total energy value $E^p{}_x(f)$ is determined by the following relation:

$$E^p{}_x(f)=W(f)\otimes E_x(f),$$

and said perceptual noise energy $E^p{}_n(f)$ is determined by the following relation:

$$E^p{}_n(f)=W(f)\otimes E_n(f),$$

wherein $E_x(f)$ is said respective total signal energy and $E_n(f)$ is said respective current estimate of the noise energy, ⊗denotes convolution and W(f) is an auditory filter centered at f.

4. The method of claim 1 wherein said estimated respective signal-to-noise ratio (SNRest) is determined by the following relation:

$$SNR_{est}(f)=|G(f)|^2\cdot SNR_{post}(f),$$

wherein G(f) is a prior respective signal gain and SNRpost is said respective local signal-to-noise ratio.

5. The method of claim 1 wherein said respective smoothed signal-to-noise ratio (SNRprior) is determined by the following relation:

$$SNR_{prior}(f)=(1-\gamma)SNR_{post}(f)+\gamma SNR_{est}(f),$$

wherein γ is a smoothing constant, SNRpost is said respective local signal-to-noise ratio and SNRest is said estimated respective signal-to-noise ratio.

6. The method of claim 1 wherein said respective filter gain value is determined by the following relation:

$$G(f)=C\cdot\sqrt{[SNRprior(f)]},$$

wherein SNRprior is said respective smoothed signal-to-noise ratio.

7. The method of claim 1 further comprising the step of forming said at least one of said plurality of frames from a first number of new speech samples and a second number of prior speech samples.

8. The method of claim 1 further comprising the step of forming said plurality of frequency bands by carrying out a fast Fourier transform (FFT) on said at least one of said plurality of frames.

9. The method of claim 1 further comprising the steps of:

determining whether said at least one of said plurality of frames is a non-speech frame;

updating, when said at least one of said plurality of frames is a non-speech frame, said current estimate of the noise energy level of said at least one of said plurality of bands of said at least one of said plurality of frames; and determining said respective filter gain value as a function of said updated current estimate of the noise energy level.

10. The method of claim 9 wherein said at least one of said plurality of frames is determined to be a non-speech frame when said at least one frame is a stationary frame.

11. The method of claim 10 wherein said at least a respective one of said plurality of frames is determined to be a stationary frame when a difference in a logarithm of an energy of said at least one frame and a logarithm in an energy of at a prior one of said plurality of frames is less than a first predefined threshold value and said linear predictive coding (LPC) prediction error exceeds a second predefined threshold value.

12. The method of claim 11 wherein said LPC prediction error (PE) is determined by the following relation:

$$PE = \prod_{k=0}^{K-1} [1 - rc_k^2],$$

wherein $rc_k$ is a reflection coefficient generated by LPC analysis.

13. The method of claim 9 wherein said at least one of said plurality of frames is determined to be a non-speech frame as a function of a sum of weighted values, each of said weighted values corresponding to a respective one of said frequency bands of said respective one of said plurality of frames, each of said weighted values being a product of a logarithm of a speech likelihood metric of said corresponding one of said frequency bands and a weighting factor of said corresponding one of said frequency bands, and when said linear predictive coding (LPC) prediction error exceeds a second predefined threshold value.

14. The method of claim 13 wherein said speech likelihood metric of said corresponding one of said frequency bands is determined by the following relation:

$$\Lambda(f) = \frac{e^{\left[\left(\frac{SNR_{prior}(f)}{1+SNR_{prior}(f)}\right)SNR_{post}(f)\right]}}{1+SNR_{prior}(f)},$$

wherein SNRpost is said respective local signal-to-noise ratio and SNRprior is said respective smoothed signal-to-noise ratio.

15. The method of claim 13 wherein an said filter gain is set to a minimum value when said speech likelihood metric is less than a threshold value.

16. The method of claim 13 wherein said LPC prediction error (PE) is determined by the following relation:

$$PE = \prod_{k=0}^{K-1} [1 - rc_k^2],$$

wherein $rc_k$ is a reflection coefficient generated by LPC analysis.

17. The method of claim 9 wherein said at least a respective one of said plurality of frames is determined to be a non-speech frame as a function of a normalized skewness value of a linear predictive coding (LPC) residual of said at least a respective one of said plurality of frames and when said linear predictive coding (LPC) prediction error exceeds a second redefined threshold value.

18. The method of claim 17 wherein said skewness value of said LPC residual is determined by the following relation:

$$SK = \frac{1}{N}\sum_{n=0}^{N-1} [e(n)]^3,$$

wherein e(n) are sampled values of an LPC residual, and N is a frame length.

19. The method of claim 18 wherein said skewness value is normalized by a function of an estimated value of a total energy $E_x$ of said respective one of said plurality of frames, said total energy $E_x$ being determined by the following relation:

$$E_x = \frac{1}{N}\sum_{n=0}^{N-1} [e(n)]^2,$$

wherein e(n) are sampled values of an LPC residual, and N is a frame length.

20. The method of claim 19 wherein said normalized skewness value $\gamma_3$ is determined by the following relation:

$$\gamma_3 = \frac{SK}{E_x^{1.5}}.$$

21. The method of claim 17 wherein said LPC prediction error (PE) is determined by the following relation:

$$PE = \prod_{k=0}^{K-1} [1 - rc_k^2],$$

wherein $rc_k$ is a reflection coefficient generated by LPC analysis.

22. The method of claim 18 wherein said skewness value is normalized by a function of an estimated value of a variance of said skewness value, said variance being determined by the following relation:

$$Var[SK] = \frac{15E_n^3}{N},$$

wherein $E_n$ is said current estimate of the noise energy level and N is a frame length.

23. The method of claim 22 wherein said normalized skewness value $\gamma_3'$ is determined by the following relation:

$$\gamma_3' = \frac{SK}{\sqrt{\frac{15E_n^3}{N}}}.$$

24. The method of claim 9 wherein said current estimate of the noise energy level is determined by the following relation:

$$E(m+1, f)=(1-\alpha)E(m,f)+\alpha E_{ch}(m,f),$$

wherein E(m,f) is a prior estimated noise energy level, Ech(m,f) is a band energy, m is an iteration index and $\alpha$ is an update constant.

25. The method of claim 24 wherein a value of said update constant $\alpha$ is determined by one of a watchdog timer being expired, said at least one of said plurality of frames being stationary, said at least one of said plurality of frames being a non-speech frame, a LPC residual of said at least one of said plurality of frames having substantially zero skewness, a current value of said estimated noise energy level being greater than a total energy of said plurality of frames and said linear predictive coding (LPC) predicting error exceeding a predefined threshold value.

26. The method of claim 25 wherein said LPC prediction error (PE) is determined by the following relation:

$$PE = \prod_{k=0}^{K-1} [1 - rc_k^2],$$

wherein $rc_k$ is a reflection coefficient generated by LPC analysis.

27. The method of claim 24 wherein said estimated noise level is forced to be updated when said estimated noise level is not updated within a preset interval.

28. The method of claim 24 wherein said update constant $\alpha$ has a value of 0.002 when a watchdog timer is expired and said linear predictive coding (LPC) prediction error (PE) exceeds a predefined LPC prediction error threshold value $T_{PE1}$; said update constant $\alpha$ has a value of 0.05 when said at least one of said plurality of frames is stationary; said update constant $\alpha$ has a value of 0.1 when a noise likelihood value is less than a noise likelihood threshold value $T_{LIK}$ and said LPC prediction error PE is greater than a predefined LPC prediction error threshold value $T_{PE2}$ such that said at least one of said plurality of frames is a non-speech frame; said update constant $\alpha$ has a value of 0.05 when an absolute value of a normalized skewness of a LPC residual is less than a first threshold value $T_a$, said skewness of said LPC residual being normalized by total energy, or is less than a second threshold value $T_b$, said skewness of said LPC residual being normalized by a variance of said skewness of said LPC residual, and when said LPC prediction error PE is greater than a predefined LPC prediction error threshold value $T_{PE2}$ so that said LPC residual of said at least one of said plurality of frames has substantially zero skewness; and said update constant $\alpha$ has a value of 0.1 when a current value of said estimated noise energy level is greater than a total energy of said plurality of frames.

29. The method of claim 1 wherein said filter gain is further adjusted as a function of an aggressiveness setting parameter (F) according to the following relation:

$$G'(f)=\sqrt{[1-F\cdot(1-G(f)^2)]},$$

wherein G(f) is said filtering gain prior to being adjusted.

30. The method of claim 1 further comprising the steps of: determining a respective speech likelihood metric of each of said plurality of said frequency bands of said at least one of said plurality of frames; determining a number of said plurality of said frequency bands having said respective speech likelihood metric above a threshold value; and setting, when said number exceeds a predetermined percentage of a total number of said plurality of said frequency bands, said filter gain for each of said plurality of said frequency bands to a minimum value.

31. A method of reducing noise in a transmitted signal comprised of a plurality of frames, each of said frames including a plurality of frequency bands; said method comprising the steps of:

determining, as a function of a linear predictive coding (LPC) prediction error, whether at least a respective one of said plurality of frames is a non-speech frame;

estimating, when said at least one of said plurality of frames is a non-speech frame, a noise energy level of at least one of said plurality of bands of said at least a respective one of said plurality of frames; and filtering said at least one band as a function of said estimated noise level.

32. The method of claim 31 wherein said at least a respective one of said plurality of frames is determined to be a non-speech frame when said at least one frame is a stationary frame.

33. The method of claim 32 wherein said at least a respective one of said plurality of frames is determined to be a stationary frame when a difference in a logarithm of an energy of said at least one frame and a logarithm in an energy of at a prior one of said plurality of frames is less than a first predefined threshold value and said linear predictive coding (LPC) prediction error exceeds a second predefined threshold value.

34. The method of claim 33 wherein said LPC prediction error (PE) is determined by the following relation:

$$PE=\prod_{k=0}^{K-1}[1-rc_k^2],$$

wherein $rc_k$ is a reflection coefficient generated by LPC analysis.

35. The method of claim 31 wherein said at least a respective one of said plurality of frames is determined to be a non-speech frame as a function of a sum of weighted values, each of said weighted values corresponding to a respective one of said frequency bands of said respective one of said plurality of frames, each of said weighted values being a product of a logarithm of a speech likelihood metric of said corresponding one of said frequency bands and a weighting factor of said corresponding one of said frequency bands, and when said linear predictive coding (LPC) prediction error exceeds a second predefined threshold value.

36. The method of claim 35 wherein said speech likelihood metric of said corresponding one of said frequency bands is determined by the following relation:

$$\Lambda(f)=\frac{e^{\left[\left(\frac{SNR_{prior}(f)}{1+SNR_{prior}(f)}\right)SNR_{post}(f)\right]}}{1+SNR_{prior}(f)},$$

wherein SNRpost is said respective local signal-to-noise ratio and SNRprior is said respective smoothed signal-to-noise ratio.

37. The method of claim 35 wherein said LPC prediction error (PE) is determined by the following relation:

$$PE=\prod_{k=0}^{K-1}[1-rc_k^2],$$

wherein $rc_k$ is a reflection coefficient generated by LPC analysis.

38. The method of claim 31 wherein said at least a respective one of said plurality of frames is determined to be a non-speech frame as a function of a normalized skewness value of said linear predictive coding (LPC) residual of said at least a respective one of said plurality of frames and when of a linear predictive coding (LPC) prediction error exceeds a second predefined threshold value.

39. The method of claim 38 wherein said skewness value of said LPC residual is determined by the following relation:

$$SK=\frac{1}{N}\sum_{n=0}^{N-1}[e(n)]^3,$$

wherein e(n) are sampled values of said LPC residual, and N is a frame length.

40. The method of claim 39 wherein said skewness value is normalized by a function of an estimated value of a total energy $E_x$ of said respective one of said plurality of frames, said total energy $E_x$ being determined by the following relation:

$$E_x = \frac{1}{N}\sum_{n=0}^{N-1}[e(n)]^2,$$

wherein e(n) are sampled values of said LPC residual, and N is a frame length.

41. The method of claim 40 wherein said normalized skewness value $\gamma_3$ is determined by the following relation:

$$\gamma_3 = \frac{SK}{E_x^{1.5}}.$$

.

42. The method of claim 38 wherein said LPC prediction error (PE) is determined by the following relation:

$$PE = \prod_{k=0}^{K-1}[1 - rc_k^2],$$

wherein $rc_k$ is a reflection coefficient generated by LPC analysis.

43. The method of claim 39 wherein said skewness value is normalized by a function of an estimated value of a variance of said skewness value, said variance being determined by the following relation:

$$Var[SK] = \frac{15E_n^3}{N},$$

wherein $E_n$ is said current estimate of the noise energy level and N is a frame length.

44. The method of claim 43 wherein said normalized skewness value $\gamma_3'$ is determined by the following relation:

$$\gamma_3' = \frac{SK}{\sqrt{\frac{15E_n^3}{N}}}.$$

45. The method of claim 31 wherein said estimated noise level is determined by the following relation:

$$E(m+1,f)=(1-\alpha)E(m,f)+\alpha E_{ch}(m,f),$$

wherein E(m,f) is a prior estimated noise energy level, Ech(m,f) is a band energy, m is an iteration index and $\alpha$ is an update constant.

46. The method of claim 45 wherein a value of said update constant $\alpha$ is determined by one of a watchdog timer being expired, said at least one of said plurality of frames being stationary, said at least one of said plurality of frames being a non-speech frame, a LPC residual of said at least one of said plurality of frames having substantially zero skewness, a current value of said estimated noise energy level being greater than a total energy of said plurality of frames and a linear predictive coding (LPC) prediction error exceeding a predefined threshold value.

47. The method of claim 46 wherein said LPC prediction error (PE) is determined by the following relation:

$$PE = \prod_{k=0}^{K-1}[1 - rc_k^2],$$

wherein $rc_k$ is a reflection coefficient generated by LPC analysis.

48. The method of claim 45 wherein said update constant $\alpha$ has a value of 0.002 when a watchdog timer is expired and said linear predictive coding (LPC) prediction error (PE) exceeds a predefined LPC prediction error threshold value $T_{PE1}$; said update constant $\alpha$ has a value of 0.05 when said at least one of said plurality of frames is stationary; said update constant $\alpha$ has a value of 0.1 when a noise likelihood value is less than a noise likelihood threshold value $T_{LIK}$ and said LPC prediction error PE is greater than a predefined LPC prediction error threshold value $T_{PE2}$ such that said at least one of said plurality of frames is a non-speech frame; said update constant $\alpha$ has a value of 0.05 when an absolute value of a normalized skewness of a LPC residual is less than a first threshold value $T_a$, said skewness of said LPC residual being normalized by total energy, or is less than a second threshold value $T_b$, said skewness of said LPC residual being normalized by a variance of said skewness of said LPC residual, and when said LPC prediction error PE is greater than a predefined LPC prediction error threshold value $T_{PE2}$ so that said LPC residual of said at least one of said plurality of frames has substantially zero skewness; and said update constant $\alpha$ has a value of 0.1 when a current value of said estimated noise energy level is greater than a total energy of said plurality of frames.

49. An apparatus of reducing noise in a transmitted signal including a plurality of frames, each of said frames including a plurality of frequency bands; said apparatus comprising:

means for determining a respective total signal energy and a respective current estimate of the noise energy for at least one of said plurality of frequency bands of at least one of said plurality of frames, wherein said respective current estimate of the noise energy is determined as a function of a linear predictive coding (LPC) prediction error;

means for determining a respective local signal-to-noise ratio (SNRpost) for said at least one of said plurality of frequency bands as a function of said respective signal energy and said respective current estimate of the noise energy;

means for determining a respective smoothed signal-to-noise ratio (SNRprior) for said at least one of said plurality of frequency bands from said respective local signal-to-noise ratio and another respective signal-to-noise ratio (SNRest) estimated for a previous frame; and means for calculating a respective filter gain value for said at least one of said plurality of frequency bands from said respective smoothed signal-to-noise ratio.

50. The apparatus of claim 49 wherein said respective local signal-to-noise ratio ($SNR_{post}$) is determined by the following relation:

$$SNR_{post}(f) = POS\left[\frac{E_x^p(f)}{E_n^p(f)} - 1\right],$$

wherein POS[x] has the value x when x is positive and has the value 0 otherwise, $E_x^p(f)$ is a perceptual total energy value and $E_n^p(f)$ is a perceptual noise energy value.

51. The apparatus of claim 50 wherein said perceptual total energy value $E^p_x(f)$ is determined by the following relation:

$$E^p_x(f)=W(f)\otimes E_x(f),$$

and said perceptual noise energy $E^p_n(f)$ is determined by the following relation:

$$E^p_n(f)=W(f)\otimes E_n(f),$$

wherein $E_x(f)$ is said respective total signal energy and $E_n(f)$ is said respective current estimate of the noise energy, ⊗denotes convolution and W(f) is an auditory filter centered at f.

52. The apparatus of claim 49 wherein said estimated respective signal-to-noise ratio (SNRest) is determined by the following relation:

$$SNR_{est}(f)=|G(f)|^2\cdot SNR_{post}(f),$$

wherein G(f) is a prior respective signal gain and SNRpost is said respective local signal-to-noise ratio.

53. The apparatus of claim 49 wherein said respective smoothed signal-to-noise ratio (SNRprior) is determined by the following relation:

$$SNR_{prior}(f)=(1-\gamma)SNR_{post}(f)+\gamma SNR_{est}(f),$$

wherein γ is a smoothing constant, SNRpost is said respective local signal-to-noise ratio and SNRest is said estimated respective signal-to-noise ratio.

54. The apparatus of claim 49 wherein said respective filter gain value is determined by the following relation:

$$G(f)=C\cdot\sqrt{[SNRprior(f)]},$$

wherein SNRprior is said respective smoothed signal-to-noise ratio.

55. The apparatus of claim 49 further comprising the means for forming said at least one of said plurality of frames from a first number of new speech samples and a second number of prior speech samples.

56. The apparatus of claim 49 further comprising means for forming said plurality of frequency bands by carrying out a fast Fourier transform (FFT) on said at least one of said plurality of frames.

57. The apparatus of claim 49 further comprising:

means for determining whether said at least one of said plurality of frames is a non-speech frame;

means for updating, when said at least one of said plurality of frames is a non-speech frame, said current estimate of the noise energy level of said at least one of said plurality of bands of said at least one of said plurality of frames; and means for determining said respective filter gain value as a function of said updated current estimate of the noise energy level.

58. The apparatus of claim 57 wherein said at least one of said plurality of frames is determined to be a non-speech from when said at least one frame is a stationary frame.

59. The apparatus of claim 58 wherein said at least a respective one of said plurality of frames is determined to be a stationary frame when a difference in a logarithm of an energy of said at least one frame and a logarithm in an energy of at a prior one of said plurality of frames is less than a first predefined threshold value and said linear predictive coding (LPC) prediction error exceeds a second predefined threshold value.

60. The of claim 59 wherein said LPC prediction error (PE) is determined by the following relation:

$$PE = \prod_{k=0}^{K-1} [1 - rc_k^2],$$

wherein $rc_k$ is a reflection coefficient generated by LPC analysis.

61. The apparatus of claim 58 wherein said at least one of said plurality of frames is determined to be a non-speech frame as a function of a sum of weighted value, each of said weighted values corresponding to a respective one of said frequency bands of said respective one of said plurality of frames, each of said weighted values being a product of a logarithm of a speech likelihood metric of said corresponding one of said frequency bands and a weighting factor of said corresponding one of said frequency bands, and when said linear predictive coding (LPC) prediction error exceeds a second predefined threshold value.

62. The apparatus of claim 61 wherein said speech likelihood metric of said corresponding one of said frequency bands is determined by the following relation:

$$\Lambda(f) = \frac{e^{\left[\left(\frac{SNR_{prior}(f)}{1+SNR_{prior}(f)}\right)SNR_{post}(f)\right]}}{1 + SNR_{prior}(f)},$$

wherein $SNR_{post}$ is said respective local signal-to-noise ratio and $SNR_{prior}$ is said respective smoothed signal-to-noise ratio.

63. The apparatus of claim 61 wherein said filter gain is set to a minimum value when said speech likelihood metric is less than a threshold value.

64. The of claim 61 wherein said LPC prediction error (PE) is determined by the following relation:

$$PE = \prod_{k=0}^{K-1} [1 - rc_k^2],$$

wherein $rc_k$ is a reflection coefficient generated by LPC analysis.

65. The apparatus of claim 57 wherein said at least a respective one of said plurality of frames is determined to be a non-speech frame as a function of a normalized skewness value of a linear predictive coding (LPC) residual of said at least a respective one of said plurality of frames and when a linear predictive coding (LPC) prediction error exceeds a second predefined threshold value.

66. The apparatus of claim 65 wherein said skewness value of said LPC residual is determined by the following relation:

$$SK = \frac{1}{N}\sum_{n=0}^{N-1}[e(n)]^3,$$

wherein e(n) are sampled values of said LPC residual, and N is a frame length.

67. The apparatus of claim 66 wherein said skewness value is normalized by an estimated value of a total energy $E_x$ of said respective one of said plurality of frames, said total energy $E_x$ being determined by the following relation:

$$E_x = \frac{1}{N}\sum_{n=0}^{N-1}[e(n)]^2,$$

wherein e(n) are sampled values of said LPC residual, and N is a frame length.

68. The of claim 67 wherein said normalized skewness value $\gamma_3$ is determined by the following relation:

$$\gamma_3 = \frac{SK}{E_x^{1.5}}.$$

69. The of claim 65 wherein said LPC prediction error (PE) is determined by the following relation:

$$PE = \prod_{k=0}^{K-1}[1 - rc_k^2],$$

wherein $rc_k$ is a reflection coefficient generated by LPC analysis.

70. The apparatus of claim 66 wherein said skewness value is normalized by a function of an estimated value of a variance of said skewness value, said variance being determined by the following relation:

$$Var[SK] = \frac{15E_n^3}{N},$$

wherein $E_n$ is said current estimate of the noise energy level and N is a frame length.

71. The of claim 70 wherein said normalized skewness value $\gamma_3'$ is determined by the following relation:

$$\gamma_3' = \frac{SK}{\sqrt{\frac{15E_n^3}{N}}}.$$

72. The apparatus of claim 49 wherein said filter gain is further adjusted as a function of an aggressiveness setting parameter (F) according to the following relation:

$$G'(f)=\sqrt{[1-F\cdot(1-G(f)^2)]},$$

wherein G(f) is said filtering gain prior to being adjusted.

73. The apparatus of claim 49 further comprising the steps of:

determining a respective speech likelihood metric of each of said plurality of said frequency bands of said at least one of said plurality of frames; determining a number of said plurality of said frequency bands having said respective speech likelihood metric above a threshold value; and setting, when said number exceeds a predetermined percentage of a total number of said plurality of said frequency bands, said filter gain for each of said plurality of said frequency bands to a minimum value.

74. The apparatus of claim 57 wherein said estimated noise level is determined by the following relation:

$$E(m+1, f)=(1-\alpha)E(m,f)+\alpha E_{ch}(m,f),$$

wherein E(m,f) is a prior estimated noise energy level, $E_{ch}$(m,f) is a band energy, m is an iteration index and $\alpha$ is an update constant.

75. The apparatus of claim 74 wherein a value of said update constant $\alpha$ is determined by one of a watchdog timer being expired, said at least one of said plurality of frames being stationary, said at least one of said plurality of frames being a non-speech frame, a LPC residual of said at least one of said plurality of frames having substantially zero skewness, a current value of said estimated noise energy level being greater than a total energy of said plurality of frames and said linear predictive coding (LPC) prediction error exceeding a predefined threshold value.

76. The of claim 75 wherein said LPC prediction error (PE) is determined by the following relation:

$$PE = \prod_{k=0}^{K-1}[1 - rc_k^2],$$

wherein $rc_k$ is a reflection coefficient generated by LPC analysis.

77. The apparatus of claim 57 wherein said estimated noise level is forced to be updated when said estimated noise level is not updated within a preset interval.

78. The of claim 74 wherein said update constant $\alpha$ has a value of 0.002 when a watchdog timer is expired and said linear predictive coding (LPC) prediction error (PE) exceeds a predefined LPC prediction error threshold value $T_{PE1}$; said update constant $\alpha$ has a value of 0.05 when said at least one of said plurality of frames is stationary; said update constant $\alpha$ has a value of 0.1 when a noise likelihood value is less than a noise likelihood threshold value $T_{LIK}$ and said LPC prediction error PE is greater than a predefined LPC prediction error threshold value $T_{PE2}$ such that said at least one of said plurality of frames is a non-speech frame; said update constant $\alpha$ has a value of 0.05 when an absolute value of a normalized skewness of a LPC residual is less than a first threshold value $T_a$, said skewness of said LPC residual being normalized by total energy, or is less than a second threshold value $T_b$, said skewness of said LPC residual being normalized by a variance of said skewness of said LPC residual, and when said LPC prediction error PE is greater than a predefined LPC prediction error threshold value $T_{PE2}$ so that a LPC residual of said at least one of said plurality of frames has substantially zero skewness; and said update constant $\alpha$ has a value of 0.1 when a current value of said estimated noise energy level is greater than a total energy of said plurality of frames.

79. An apparatus of reducing noise in a transmitted signal including a plurality of frames, each of said frames including a plurality of frequency bands; said apparatus comprising the steps of:

means for determining, as a function of a linear predictive coding (LPC) prediction error, whether at least a respective one of said plurality of frames is a non-speech frame;

means for estimating, when said at least one of said plurality of frames is a non-speech frame, a noise energy level of at least one of said plurality of bands of said at least a respective one of said plurality of frames; and means for filtering said at least one band as a function of said estimated noise level.

80. The apparatus of claim 79 wherein said at least a respective one of said plurality of frames is determined to be a non-speech frame when said at least one frame is a stationary frame.

81. The apparatus of claim 80 wherein said at least a respective one of said plurality of frames is determined to be a stationary frame when a difference in a logarithm of an energy of said at least one frame and a logarithm in an energy of at a prior one of said plurality of frames is less than a first predefined threshold value and said linear predictive coding (LPC) prediction error exceeds a second predefined threshold value.

82. The of claim 81 wherein said LPC prediction error (PE) is determined by the following relation:

$$PE = \prod_{k=0}^{K-1} [1 - rc_k^2],$$

wherein $rc_k$ is a reflection coefficient generated by LPC analysis.

83. The apparatus of claim 79 wherein said at least a respective one of said plurality of frames is determined to be a non-speech frame as a function of a sum of weighted values, each of said weighted values corresponding to a respective one of said frequency bands of said respective one of said plurality of frames, each of said weighted values being a product of a logarithm of a speech likelihood metric of said corresponding one of said frequency bands and a weighting factor of said corresponding one of said frequency bands, and when said linear predictive coding (LPC) prediction error exceeds a second predefined threshold value.

84. The apparatus of claim 83 wherein said speech likelihood metric of said corresponding one of said frequency bands is determined by the following relation:

$$\Lambda(f) = \frac{e^{\left[\left(\frac{SNR_{prior}(f)}{1+SNR_{prior}(f)}\right)SNR_{post}(f)\right]}}{1 + SNR_{prior}(f)},$$

wherein SNRpost is said respective local signal-to-noise ratio and SNRprior is said respective smoothed signal-to-noise ratio.

85. The of claim 83 wherein said LPC prediction error (PE) is determined by the following relation:

$$PE = \prod_{k=0}^{K-1} [1 - rc_k^2],$$

wherein $rc_k$ is a reflection coefficient generated by LPC analysis.

86. The apparatus of claim 79 wherein said at least a respective one of said plurality of frames is determined to be a non-speech frame as a function of a normalized skewness value of a linear predictive coding (LPC) residual of said at least a respective one of said plurality of frames and when said linear predictive coding (LPC) prediction error exceeds a second predefined threshold value.

87. The apparatus of claim 86 wherein said skewness value of said LPC residual is determined by the following relation:

$$SK = \frac{1}{N}\sum_{n=0}^{N-1} [e(n)]^3,$$

wherein e(n) are sampled values of an LPC residual, and N is a frame length.

88. The apparatus of claim 87 wherein said skewness value is normalized by a function of an estimated value of a variance of said skewness value, said variance being determined by the following relation:

$$Var[SK] = \frac{15E_n^3}{N},$$

wherein $E_n$ is said current estimate of the noise energy level and N is a frame length.

89. The of claim 88 wherein said normalized skewness value $\gamma_3'$ is determined by the following relation:

$$\gamma_3' = \frac{SK}{\sqrt{\frac{15E_n^3}{N}}}.$$

90. The apparatus of claim 86 wherein said skewness value is normalized by an estimated value of a total energy $E_x$ of said respective one of said plurality of frames, said total energy $E_x$ being determined by the following relation:

$$E_x = \frac{1}{N}\sum_{n=0}^{N-1} [e(n)]^2,$$

wherein e(n) are sampled values of said LPC residual, and N is a frame length.

91. The of claim 90 wherein said normalized skewness value $\gamma_3$ is determined by the following relation:

$$\gamma_3 = \frac{SK}{E_x^{1.5}}.$$

92. The of claim 86 wherein said LPC prediction error (PE) is determined by the following relation:

$$PE = \prod_{k=0}^{K-1} [1 - rc_k^2],$$

wherein $rc_k$ is a reflection coefficient generated by LPC analysis.

93. The apparatus of claim 79 wherein said estimated noise level is determined by the following relation:

$$E(m+1,f)=(1-\alpha)E(m,f)+\alpha E_{ch}(m,f),$$

wherein E(m,f) is a prior estimated noise energy level, Ech(m,f) is a band energy, m is an iteration index and a is an update constant.

94. The apparatus of claim 93 wherein a value of said update constant $\alpha$ is determined by one of a watchdog timer being expired, said at least one of said plurality of frames being stationary, said at least one of said plurality of frames being a non-speech frame, a LPC residual of said at least one of said plurality of frames having substantially zero skewness, a current value of said estimated noise energy level being greater than a total energy of said plurality of frames and said linear predictive coding (LPC) prediction error exceeding a predefined threshold value.

95. The of claim 94 wherein said LPC prediction error (PE) is determined by the following relation:

$$PE = \prod_{k=0}^{K-1} [1 - rc_k^2],$$

wherein $rc_k$ is a reflection coefficient generated by LPC analysis.

96. The of claim 93 wherein said update constant $\alpha$ has a value of 0.002 when a watchdog timer is expired and said linear predictive coding (LPC) prediction error (PE) exceeds a predefined LPC prediction error threshold value $T_{PE1}$; said update constant $\alpha$ has a value of 0.05 when said at least one of said plurality of frames is stationary; said update constant $\alpha$ has a value of 0.1 when a noise likelihood value is less than a noise likelihood threshold value $T_{LIK}$ and said LPC prediction error PE is greater than a predefined LPC prediction error threshold value $T_{PE2}$ such that said at least one of said plurality of frames is a non-speech frame; said update constant $\alpha$ has a value of 0.05 when an absolute value of a normalized skewness of a LPC residual is less than a first threshold value $T_a$, said skewness of said LPC residual being normalized by total energy, or is less than a second threshold value $T_b$, said skewness of said LPC residual being normalized by a variance of said skewness of said LPC residual, and when said LPC prediction error PE is greater than a predefined LPC prediction error threshold value $T_{PE2}$ so that said LPC residual of said at least one of said plurality of frames has substantially zero skewness; and said update constant $\alpha$ has a value of 0.1 when a current value of said estimated noise energy level is greater than a total energy of said plurality of frames.

* * * * *